US009501078B2

(12) United States Patent
Manea et al.

(10) Patent No.: US 9,501,078 B2
(45) Date of Patent: Nov. 22, 2016

(54) VOLTAGE REFERENCE WITH LOW SENSITIVTY TO PACKAGE SHIFT

(71) Applicant: Atmel Corporation, San Jose, CA (US)

(72) Inventors: Danut Manea, Saratoga, CA (US); Jeff Kotowski, Nevada City, CA (US); Scott N. Fritz, San Jose, CA (US); Yongliang Wang, Saratoga, CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 14/691,432

(22) Filed: Apr. 20, 2015

(65) Prior Publication Data

US 2015/0227155 A1 Aug. 13, 2015

Related U.S. Application Data

(63) Continuation of application No. 14/099,574, filed on Dec. 6, 2013, now Pat. No. 9,013,231.

(51) Int. Cl.
*G05F 3/30* (2006.01)
*G05F 3/08* (2006.01)

(52) U.S. Cl.
CPC .. *G05F 3/08* (2013.01); *G05F 3/30* (2013.01)

(58) Field of Classification Search
CPC ..... G05F 3/08; G05F 3/30
See application file for complete search history.

(56) References Cited

U.S. PATENT DOCUMENTS

| | | | | |
|---|---|---|---|---|
| 5,059,820 | A | 10/1991 | Westwick | |
| 5,867,012 | A | 2/1999 | Tuthill | |
| 5,982,221 | A | 11/1999 | Tuthill | |
| 6,060,874 | A | 5/2000 | Doorenbos | |
| 6,819,163 | B1 | 11/2004 | Gregoire, Jr. | |
| 6,927,622 | B2 * | 8/2005 | Rashid | G05F 3/265 323/312 |
| 7,786,792 | B1 | 8/2010 | Gay | |
| 7,932,772 | B1 | 4/2011 | Zarabadi | |
| 8,461,912 | B1 | 6/2013 | Kumar | |
| 9,013,231 | B1 | 4/2015 | Manea et al. | |

OTHER PUBLICATIONS

Office Action in U.S. Appl. No. 14/099,574, dated Aug. 4, 2014, 8 pages.

* cited by examiner

*Primary Examiner* — Jeffrey Zweizig
(74) *Attorney, Agent, or Firm* — Fish & Richardson P.C.

(57) ABSTRACT

In a bandgap voltage reference with low package shift, a proportional to absolute temperature (PTAT) voltage is generated using a single diode biased at two different current levels at two different times. Using the same diode for both current density measurements removes the absolute value of the base-emitter junction voltage (Vbe) and any package shift in the PTAT voltage. The bandgap voltage reference can be implemented in a single or differential circuit topology. In some implementations, the bandgap voltage reference can include circuitry for curvature correction.

9 Claims, 4 Drawing Sheets

VOLTAGE REFERENCE WITH LOW SENSITIVTY TO PACKAGE SHIFT

CROSS-REFERENCE TO RELATED APPLICATIONS

This application is a continuation of and claims priority to U.S. application Ser. No. 14/099,574, filed Dec. 6, 2013, the entire disclosure of which is incorporated by reference.

TECHNICAL FIELD

This disclosure relates generally to voltage references for electronic circuits.

BACKGROUND

A bandgap voltage reference is a voltage reference used in integrated circuits (ICs) for producing a fixed or constant voltage independent of power supply variations, temperature changes and loading. A bandgap voltage is the combination of a bipolar (or diode) base-emitter junction voltage (Vbe) and a PTAT (proportional to absolute temperature) voltage. Vbe is roughly 650 mV at room temperature and has a negative temperature coefficient (TC). The PTAT voltage has a positive TC which, when added to the negative TC of the Vbe, creates a low-temperature coefficient reference of about 1.24 volts. That is to say that the reference varies very little over temperature.

In conventional bandgap voltage reference designs, the ΔVbe (PTAT voltage) is the difference of two diode voltages biased at different current densities. For example, the PTAT voltage may be the difference between two diodes biased at the same current level where the second diode is sized 8 times larger than the first diode for an 8:1 current density difference. This results in a PTAT voltage of Vt*ln(8) or about 54 mV at room temperature. Alternatively the same voltage could be generated by using two equal size diodes with the first diode biased at 8 times the bias current of the second diode.

Pressure from the package (e.g., a plastic package) can introduce a piezoelectric effect on the integrated circuit die that can shift Vbe and PTAT voltage (ΔVbe). The effect on the bandgap voltage due to the shift in Vbe is 1:1. For example, a 1 mV shift in Vbe shifts the bandgap voltage by 1 mV. However, the gain of the PTAT voltage is increased by a factor in the range of about 5-20 (e.g., 10) in the bandgap. Thus, most of the package shift is due to PTAT voltage sensitivity.

SUMMARY

In a bandgap voltage reference with low package shift, a proportional to absolute temperature (PTAT) voltage is generated using a single diode biased at two different current levels at two different times. Using the same diode for both current density measurements removes the absolute value of the base-emitter junction voltage (Vbe) and any package shift in the PTAT voltage. The bandgap voltage reference can be implemented in a single or differential circuit topology. In some implementations, the bandgap voltage reference can include circuitry for curvature correction.

Particular implementations of the bandgap voltage reference with low package shift provide one or more of the following advantages: 1) a method for precise reference voltage generation; 2) eliminates most of the package shift inherent in conventional bandgap voltage references; 3) is applicable to both single ended and differential implementations; and 4) optionally includes curvature correction that is also insensitive to package shift.

DETAILED DESCRIPTION

Example Circuits

Figure 1:
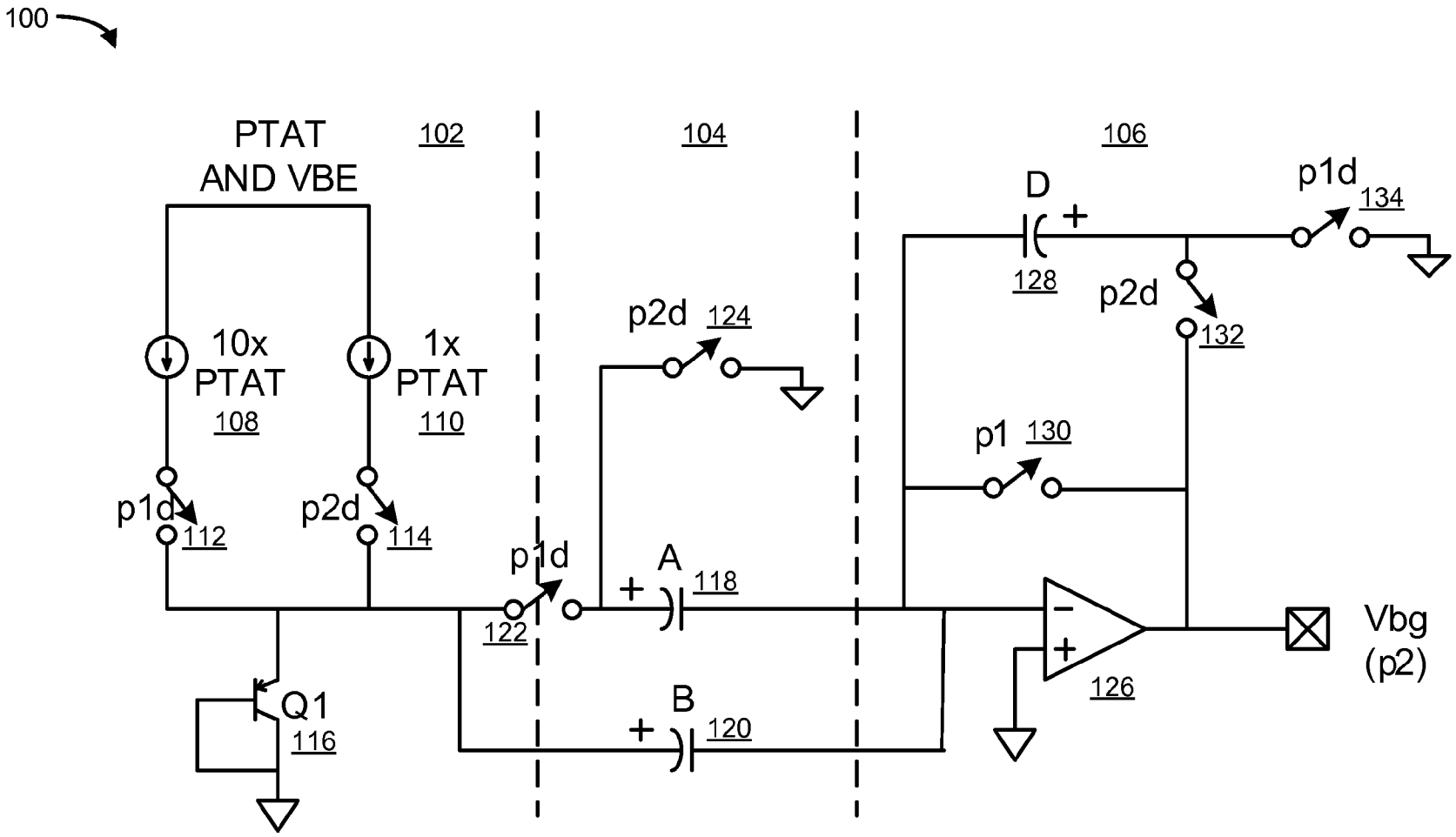
FIG. 1 is a simplified schematic diagram of an exemplary single-ended implementation of a bandgap voltage reference circuit with low sensitivity to package shift.

FIG. 1 is a simplified schematic diagram of an exemplary single-ended implementation of a bandgap voltage reference circuit 100 with low sensitivity to package shift.

In some implementations, circuit 100 can include bias voltage generator circuit 102, measurement circuit 104 and bandgap voltage generator circuit 106. Bias voltage generator circuit 102 can include a first PTAT current source 108 and a second PTAT current source 110. First PTAT current source 108 provides a current level that is higher than the current level that is provided by second PTAT current source 110. In the example shown, the current level of PTAT current source 108 is N times (e.g., 10×) the current level provided by PTAT current source 110. Any desired current ratio can be used.

PTAT current sources 108, 110 are coupled to single diode 116 through switches 112, 114. Switch 112 is closed during a first phase of operation of circuit 100 and opened during a second phase of operation of circuit 100. Switch 114 is open during the first phase of operation of circuit 100 and closed during the second phase of operation of circuit 100. Switches 112, 114 are opened and closed by switching signals as described in reference to FIG. 3. Switches 112, 114 can be implemented with transistors (e.g., MOSFET transistors) that are biased to operate as switches (e.g., MOSFET transistors). As used herein, the letters p1, p1d represent a first phase switch signal and a delayed first phase switch signal, respectively, for controlling switches during the first phase of operation of circuit 100. Likewise, the letters p2, p2d represent a second phase switch signal and a delayed second phase switch signal for controlling switches during the second phase of operation of circuit 100. The first and second phase switch signals will be discussed in more detail with respect to FIG. 3.

Measurement circuit 104 includes a first measurement capacitor 118 ("A") and a second measurement capacitor 120 ("B"). Switch 122 connects measurement circuit 104 to measurement capacitor 118 during the first phase of operation of circuit 100. Switch 124 connects measurement capacitor 118 to ground during the second phase of operation of circuit 100.

Bandgap voltage generator circuit 106 includes operational amplifier 126 and feedback capacitor 128 ("D"), which sets a gain (1/gain) for operational amplifier 126. The amplifier 126 is needed because the PTAT voltage (ΔVbe) is very small. Switch 130 shorts operational amplifier 126 during the first phase of operation of circuit 100. Switch 132 couples feedback capacitor 128 to the output of operational amplifier 126 and an inverted input of operational amplifier 126 during the second phase of operation. The positive terminal of operational amplifier 126 is tied to ground. Switch 134 couples feedback capacitor 128 to ground during the first phase of operation of circuit 100. The output of operational amplifier 126 is bandgap voltage, Vbg, which is valid only during the second phase of operation of circuit 100.

During the first phase of operation of circuit 100, switch 112 is closed and switch 114 is open, allowing PTAT current generator 108 to supply current having a first current level to diode 116, resulting in a base-emitter junction voltage Vbe across diode 116. Also, switch 122 is closed and switch 124 is open, allowing measurement capacitor 118 to sample Vbe. Also, switches 130, 134 are closed and switch 132 is opened, coupling the output of operational amplifier 126 directly to its inverting input.

During the second phase of operation of circuit 100, switch 112 is opened and switch 114 is closed, allowing PTAT current generator 110 to supply current having a second current level to diode 116, resulting in a base-emitter junction voltage Vbe across diode 116. Also, switch 122 is opened and switch 124 is closed, allowing measurement capacitor 120 to sample ΔVbe. Also, switches 130, 134 are opened and switch 132 is closed, de-coupling the output of operational amplifier 126 to its inverting input.

As described above, circuit 100 topology uses a single diode to generate the PTAT voltage (or ΔVbe). The PTAT voltage is the difference of the single diode biased at different current levels at different times. Because the PTAT voltage is the difference between two diode voltages, using the same diode for both current density measurements in bias voltage generator circuit 102 removes the absolute value of Vbe and any package shift from the PTAT voltage (ΔVbe).

For a conventional bandgap voltage reference that uses two diodes:

$$\Delta Vbe_{shift}=[Vbe1+\text{shift1}]-[Vbe2+\text{shift2}]=\Delta Vbe_{1\text{-}2}+\Delta\text{shift}_{1\text{-}2}, \quad [1]$$

where a voltage change due to package shift, $\Delta\text{shift}_{1\text{-}2}$, is included in $\Delta Vbe_{shift}$.

For circuit 100 that uses a single diode and two phase operation:

$$\Delta Vbe_{shift}=[Vbe_{i10}+\text{shift}]-[Vbe_{i1}+\text{shift}]=\Delta Vbe_{1\text{-}2}, \quad [2]$$

where the package shift voltage term is cancelled out.

Writing the charge transfer equations gives Equation[3] below, which is valid only during phase 2:

$$Vbg=\frac{Vbe\cdot A+\Delta Vbe\cdot B}{D}. \quad [3]$$

Circuit 100 described above creates a bandgap voltage reference that is largely insensitive to package stress using standard processes (e.g., no die coat) or packaging (a standard package can be used). This allows manufacturing the flexibility to use any package that is required by a customer. Additionally, product cost is lowered by the use of a standard process and package.

Figure 2:
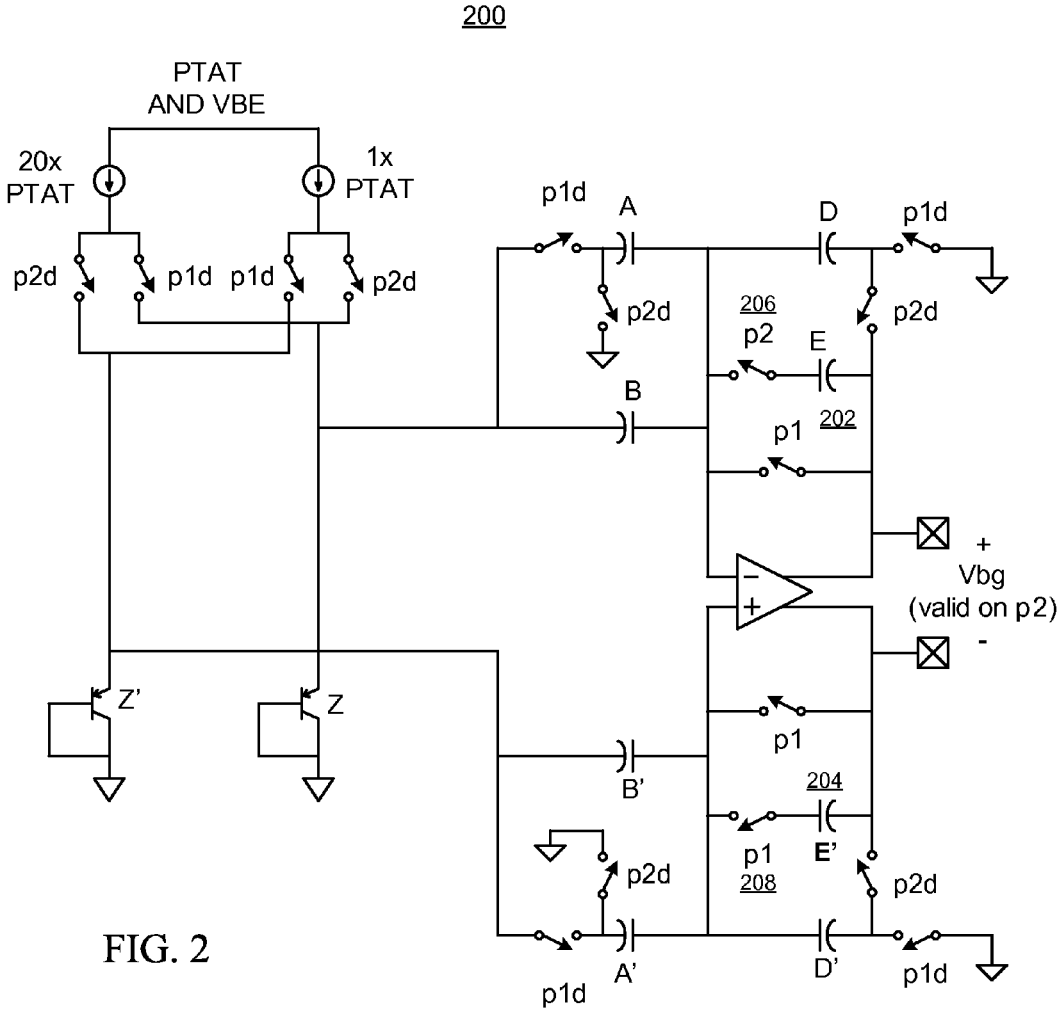
FIG. 2 is a simplified schematic diagram of an exemplary fully differential implementation of the bandgap voltage reference of FIG. 1.

FIG. 2 is a simplified schematic diagram of an exemplary fully differential implementation of the bandgap voltage reference 100 of FIG. 1. In the example differential topology shown, circuit 200 includes similar components as circuit 100 but has been configured for a differential topology. Circuit 200 operates substantially like circuit 100 and need not be described again. The lower half of circuit 200 functions in opposite phase to the upper half of circuit 200.

Circuit 200 also differs from circuit 100 in that circuit 200 includes optional filtering capacitors 302, 304 ("E" and "E'") and switches 206, 208, for implementing a low pass filter on the bandgap output (if capacitor D is also present) during the second and first phase of operation, respectively. Note that a filtering capacitor can also be added (to smooth out noise transients) to the output of the single-ended topology of circuit 100. Although two PTAT voltages are being generated for each side of the differential circuit topology of circuit 200, each PTAT voltage is generated by a single diode (Z, Z'). Also, the PTAT current ratio in this example topology is 20:1.

Figure 3:
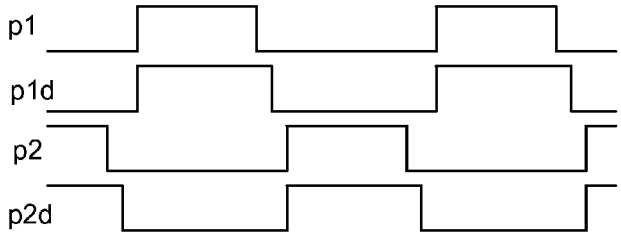
FIG. 3 illustrates clock signals used to configure the bandgap voltage reference circuit for different phases of operation.

FIG. 3 illustrates clock signals used to configure the bandgap voltage reference circuit for the first and second phases of operation. Circuits 100, 200 described above are configured for two different phases of operation. The configurations can be implemented using switches that are controlled by switch control signals. In some implementations, a clock generator circuit (not shown) generates clocks p1, p1d, p2, p2d, which are used as switch control signals for the first and second phases of operation. Clock p1d is a delayed version of clock p1 and clock p2d is a delayed version of clock p2. The delayed clocks are used to control charge injection. The clocks can be operated at any desired frequency (e.g., 500 MHz) depending on the application.

Figure 4:
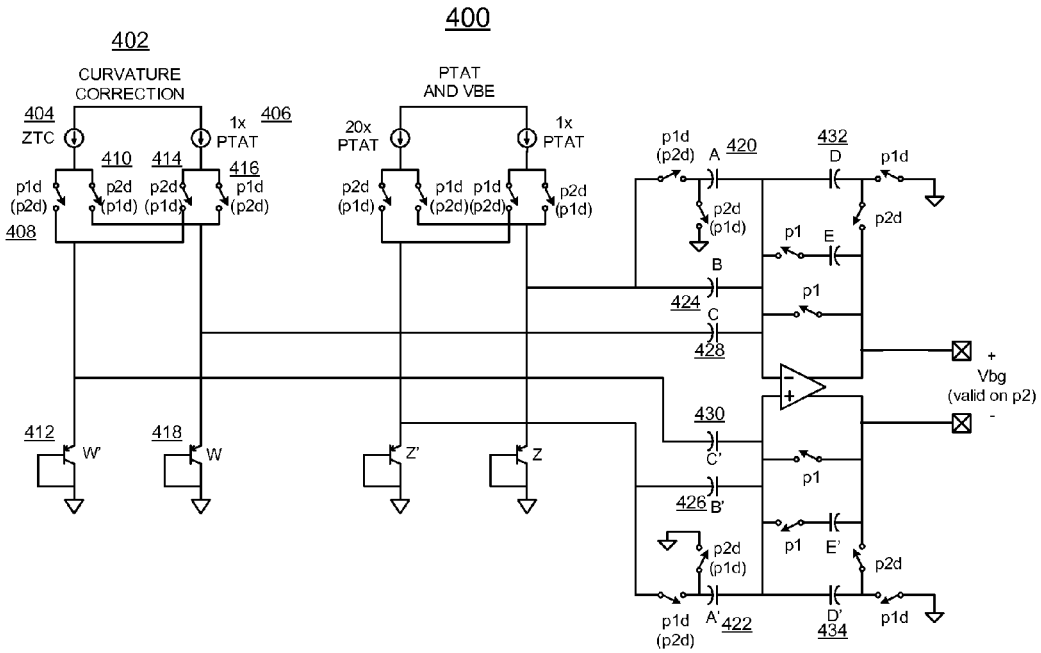
FIG. 4 is a simplified schematic diagram of an exemplary fully differential implementation of the bandgap voltage reference circuit of FIG. 2 including curvature correction and low-pass filtering.

FIG. 4 is a simplified schematic diagram of an exemplary fully differential implementation of the bandgap voltage reference circuit 400 of FIG. 2, including curvature correction and low-pass filtering. Circuit 400 functions in substantially the same manner as the differential topology of circuit 200, except that additional circuit 402 is added to provide curvature correction. Curvature correction is needed to correct for curve of the bandgap voltage versus temperature. Circuit 402 includes zero temperature coefficient (ZTC) current source 404 coupled through switches 408, 410 to diode 412 (W') and PTAT current source 406 coupled through switches 414, 416 to diode 418 (W).

Capacitors 420 (A), 422 (A') sample Vbe, capacitors 424 (B), 426 (B') sample ΔVbe and capacitors 428 (C), 430 (C') sample the curvature correction voltage, which is the difference between the ZTC voltage and PTAT voltage generated by circuit 402. Capacitors 432(D), 435 (D') set the gain in parallel with the voltage on capacitors 420, 422.

Because the curvature correction is the difference of a diode base-emitter junction voltage (Vbe) biased at two different current levels at two different times, package shift of the curvature correction is canceled.

Figure 5:
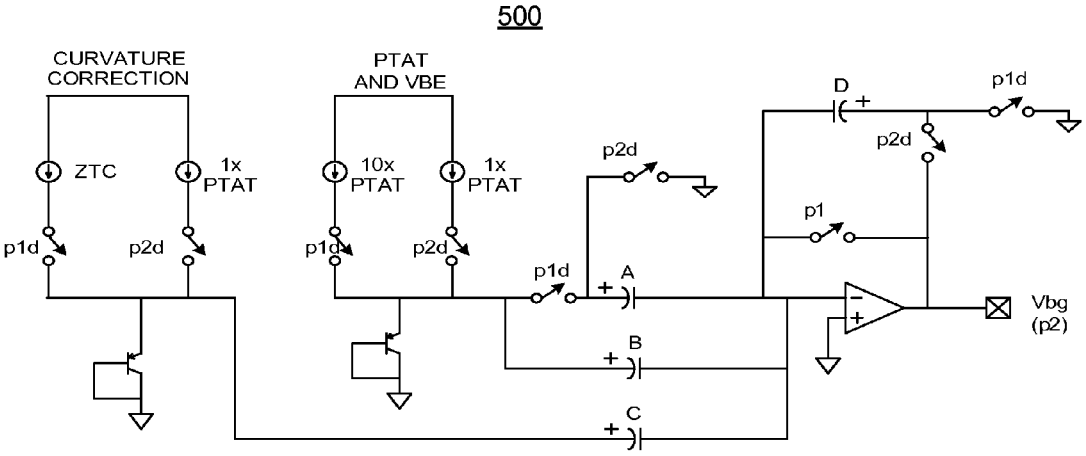
FIG. 5 is a simplified schematic diagram of an exemplary single-ended implementation of the bandgap voltage reference circuit of FIG. 1 including curvature correction.

FIG. 5 is a simplified schematic diagram of an exemplary single-ended implementation of the bandgap voltage reference circuit 500 of FIG. 1, including curvature correction. Circuit 500 operates in substantially the same manner as the differential topology of circuit 400 but is configured as a single-ended topology.

Deriving the charge transfer equation for the curvature corrected bandgap gives:

$$Vbg = \frac{Vbe \cdot A + \Delta Vbe \cdot B + Vcurve \cdot C}{D} \quad [4]$$

where:

$$Vcurve = Vt \cdot \ln\left(\frac{Iptat}{Iztc}\right). \quad [5]$$

Example Processes

Figure 6:
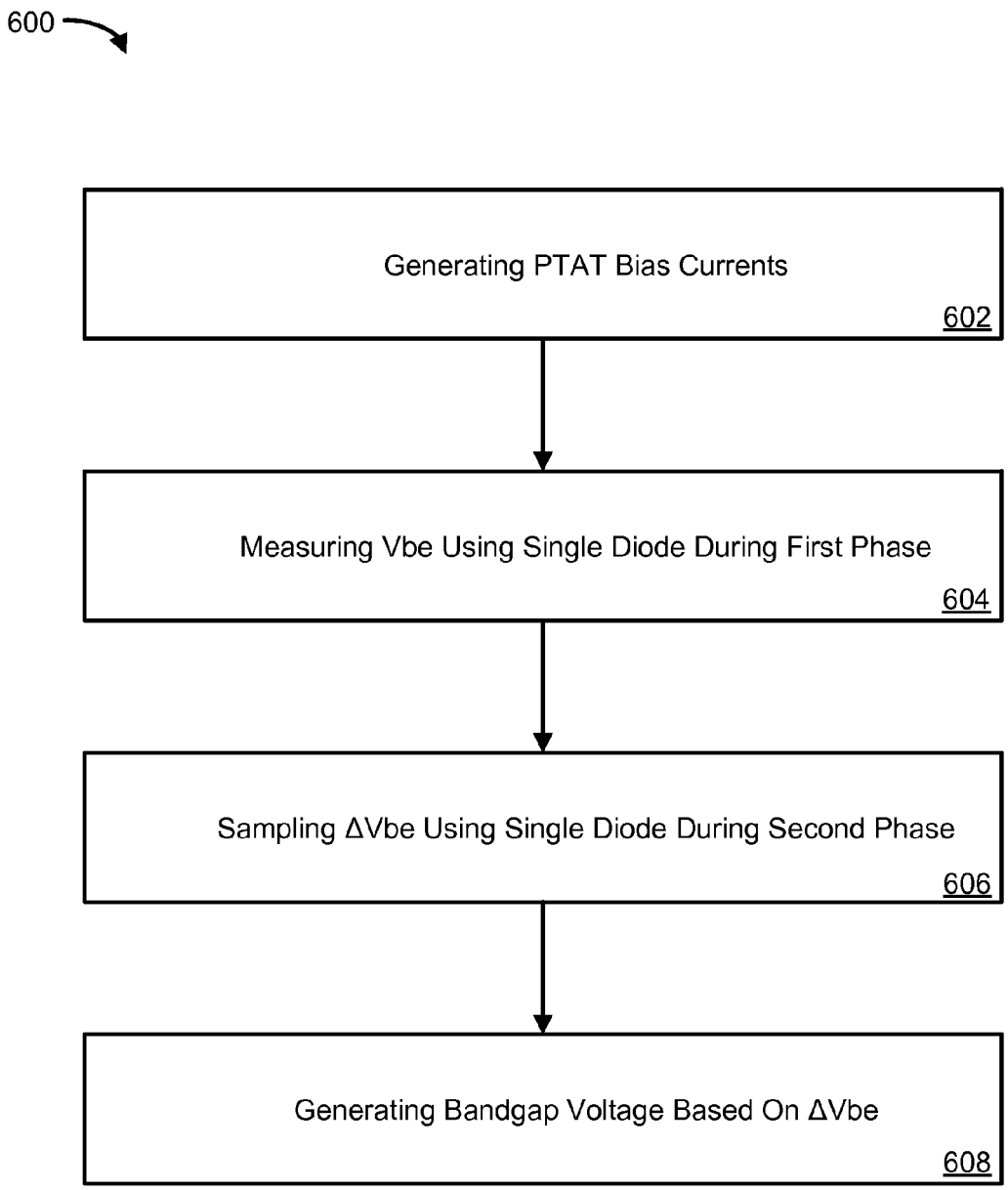
FIG. 6 is a flow diagram of an exemplary process for generating a bandgap voltage with low sensitivity to package drift.

FIG. 6 is a flow diagram of an exemplary process 600 for generating a bandgap voltage with low sensitivity to package drift. Process 600 can be implemented by any of the circuit topologies described in reference to FIGS. 1-5.

In some implementations, process 600 can begin by generating a first proportional to absolute temperature (PTAT) current by a first PTAT current source during a first phase of operation and a second PTAT current by a second PTAT current source during a second phase of operation (602), where the first and second phases occur at a different time. The first and second PTAT current sources are configured to couple to a single diode during the first and second phases of operation, respectively. The first PTAT current level is higher than the second PTAT current level. The first and second PTAT current sources are described in reference to FIGS. 1-5.

Process 600 continues by sampling a base-emitter junction voltage (Vbe) of the diode coupled to the first PTAT current source during the first phase of operation and sampling a shift in Vbe (ΔVbe or PTAB voltage) during the second phase of operation (604). Process 600 continues by generating a bandgap voltage based on ΔVbe. (606). The sampling of junction voltage can be performed by measuring capacitors as described in reference to FIGS. 1-5.

While this document contains many specific implementation details, these should not be construed as limitations on the scope what may be claimed but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A bandgap voltage reference circuit, comprising:

a bias voltage generator circuit for generating a proportional to absolute temperature (PTAT) voltage, the bias voltage generator circuit including a first PTAT current source configured to be coupled to a diode during a first phase of operation and a second PTAT current source configured to be coupled to the diode during a second phase of operation, where the first PTAT current source is configured for providing a higher current level than the second PTAT current source and where the first and second phases occur at different times;

a measurement circuit configured to be coupled to the first PTAT current source during the first phase of operation for measuring a base-emitter junction voltage (Vbe) of the diode and to be coupled to the second PTAT current source during the second phase of operation for measuring a shift in Vbe (ΔVbe);

a bandgap voltage generator circuit configured to be coupled to the measurement circuit during the second phase of operation for generating a bandgap voltage based on ΔVbe;

a first set of switches that are operable during the first phase of operation to couple the measurement circuit to the bias voltage generator circuit; and a second set of switches that during the second phase of operation are operable to couple the measured voltages to the bandgap voltage generator circuit, where the second set of switches are open when the first set of switches are closed and vice-versa, wherein the first and second sets of switches are commanded closed or open based on four clock signals, a first clock signal, a delayed version of the first clock signal, a second clock signal and a delayed version of the second clock signal.

2. The bandgap voltage reference circuit of claim 1, where the measurement circuit comprises:

a first measurement capacitor configured to be coupled to the first PTAT current source during the first phase of operation; and a second measurement capacitor configured to be coupled to the second current source during the first and second phases of operation.

3. The bandgap voltage reference circuit of claim 1, where the bandgap voltage generator comprises:

an operational amplifier coupled to the measurement circuit; and a feedback capacitor coupled between an output of the operational amplifier and an input of the operational amplifier during the second phase of operation.

4. The bandgap voltage reference circuit of claim 1, further comprising:

a curvature correction circuit coupled to the measurement circuit for correcting a non-linearity of Vbe, the curvature correction circuit including a zero temperature coefficient (ZTC) current source configured to be coupled to a second diode during the first phase of operation to produce a ZTC voltage and a third PTAT current source configured to be coupled to the second diode during the second phase of operation to provide a PTAT voltage.

5. The bandgap voltage reference circuit of claim 4, where the measurement circuit includes a third measurement capacitor coupled to the curvature correction circuit for measuring a curvature correction voltage that is a difference between the ZTC voltage and the PTAT voltage.

6. The bandgap voltage reference circuit of claim 1, further comprising:

a low-pass filter configured to be coupled the output of the bandgap voltage generator circuit during the second phase of operation.

7. A method of providing a bandgap voltage reference comprising:

generating, by a bias voltage generator circuit, a first proportional to absolute temperature (PTAT) current by a first PTAT current source during a first phase of operation and a second PTAT current by a second PTAT current source during a second phase of operation, where the first and second PTAT current sources are operable to couple to a single diode during the first phase of operation and the second phase of operation, respectively, and where the first PTAT current level is higher than the second PTAT current level and the first and second phases of operation occur at different times;

coupling, by a first set of switches during the first phase of operation, a measurement circuit to the bias voltage generator circuit;

measuring, by the measurement circuit, a base-emitter junction voltage (Vbe) of the diode coupled to the first PTAT current source during the first phase of operations;

coupling, by a second set of switches during the second phase of operation, the measured Vbe of the diode to the bandgap voltage generator circuit;

measuring a shift in Vbe (ΔVbe) during the second phase of operation; and generating a bandgap voltage based on ΔVbe, wherein the second set of switches are open when the first set of switches are closed and vice-versa, wherein the first and second sets of switches are commanded closed or open based on four clock signals, a first clock signal, a delayed version of the first clock signal, a second clock signal and a delayed version of the second clock signal.

8. The method of claim 7, further comprising:

generating a curvature correction voltage; and correcting a non-linearity of the bandgap voltage using the curvature correction voltage.

9. The method of claim 7, further comprising:

filtering the bandgap voltage using a low-pass filter.

* * * * *